US007364016B2

(12) United States Patent
Drummond

(10) Patent No.: US 7,364,016 B2
(45) Date of Patent: Apr. 29, 2008

(54) FALL ARREST SAFETY ANCHORAGE DEVICE

(76) Inventor: Bruce Alan Drummond, 144 N. Michigan Ave., Hobart, IN (US) 46342

( * ) Notice: Subject to any disclaimer, the term of this patent is extended or adjusted under 35 U.S.C. 154(b) by 506 days.

(21) Appl. No.: 10/953,968

(22) Filed: Sep. 29, 2004

(65) Prior Publication Data

US 2006/0065484 A1 Mar. 30, 2006

(51) Int. Cl.
*A62B 35/00* (2006.01)

(52) U.S. Cl. ..... 182/3; 182/82; 52/698; 248/231.9; 248/237

(58) Field of Classification Search ..... 182/3, 182/4, 36, 45, 82, 107; 248/499, 237, 231.9; 52/698

See application file for complete search history.

(56) References Cited

U.S. PATENT DOCUMENTS 5,143,171 A * 9/1992 Glynn et al. ..... 182/3
5,287,944 A 2/1994 Woodyard
6,167,986 B1 1/2001 Calvillo

* cited by examiner

*Primary Examiner*—Richard E. Chilcot, Jr.
*Assistant Examiner*—Matthew J Smith

(57) ABSTRACT

A fall arrest safety anchorage device, which can be mounted to a wide variety of rigid planar substrates by utilizing fasteners which pass through apertures in a mounting plate and into a substrate. Angularly extending from the mounting plate is a first positioning member, which projects away from the mounting area to a predetermined position where a second positioning member is attached. The second positioning member angularly extends from the first positioning member to another predetermined position where a safety equipment receiver is attached. Utilizing angles of varying degree at the points of attachment of the positioning members and varying the lengths of the positioning members, the safety equipment receiver can be positioned virtually anywhere. Most important, the safety equipment receiver can be positioned at a desired location away from the initial mounting area for the securing of fall arrest safety equipment, thus providing clearance for the installation of construction materials and allowing workers to perform work safely at heights greater than six feet. Occupational Safety and Health Administration regulations stipulate that whenever a potential for a fall at a height of six feet or more exists, fall protection must be utilized for the safety of workers.

20 Claims, 9 Drawing Sheets

FALL ARREST SAFETY ANCHORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates generally to construction site safety equipment, and more specifically to a fall arrest safety anchorage device.

Falls are the number one cause of fatalities in the construction industry. Occupational Safety and Health Administration regulations stipulate that whenever a potential for a fall at a height of six feet or more exists, fall protection must be utilized for the safety of workers. There are several types of fall protection permitted for working at heights above six feet, however, a personal fall arrest safety system is the safest. A personal fall arrest safety system generally consists of an anchorage, connectors, and body harness, but may also include a lanyard, deceleration device, or lifeline. Workers attach their adorned safety gear either to a fall arrest safety anchorage device, a horizontal lifeline, or a vertical lifeline, thereby tethering themselves at a rigid elevated position, thus aiding in the prevention of fatality or injury resulting from a fall.

A wide variety of fall arrest safety anchorage devices have been made in an attempt to provide fall protection safety for construction workers, however there are several problems with the fall arrest safety anchorage devices that are readily available. Many fall arrest safety anchorage devices must be secured to a surface where work will be performed and must be removed before many types of work can be completed. Another common problem lies in the versatility of securing the fall arrest safety anchorage devices. Many fall arrest safety anchorage devices can only be mounted in one particular way or to a particular type of material. And then there are those fall arrest safety anchorage devices which are designed for single use only and become garbage upon removal. Besides the previously mentioned problems, many of the existing fall arrest safety anchorage devices are difficult to manufacture and install.

BRIEF SUMMARY OF THE INVENTION

The present invention is a versatile fall arrest safety anchorage device, which can be used in pairs for horizontal lifeline attachment or individually for vertical lifeline and other fall arrest safety equipment attachment. The fall arrest safety anchorage device can be secured to a wide variety of vertical, horizontal, or inclined rigid planar substrates. When utilized in a pair at opposing corner locations of a building structure for horizontal lifeline attachment, the fall arrest safety anchorage devices will provide clearance between the horizontal lifeline and a working surface, thus allowing for the safe installation of a wide variety of construction materials, before the removal of safety equipment.

Accordingly, several objects and advantages of the current invention are as follows.

An object of the invention is to provide a new and improved fall arrest safety anchorage device for providing fall protection for workers during the construction process or while performing service work.

Another object of the invention is to provide a new and improved fall arrest safety anchorage device that can be mounted in several different ways.

A further object of the invention is to provide a new and improved fall arrest safety anchorage device that can be secured to a wide variety of vertical, horizontal, or inclined rigid planar substrates.

A further object of the invention is to provide a new and improved fall arrest safety anchorage device that meets all Occupational Safety and Health Administration regulations.

A further object of the invention is to provide a new and improved fall arrest safety anchorage device that can remain in place until a substantial amount of work or service is performed.

A further object of the invention is to provide a new and improved fall arrest safety anchorage device that is relatively easy to install and remove.

A further object of the invention is to provide a new and improved fall arrest safety anchorage device that has a high degree of integral strength.

A further object of the invention is to provide a new and improved fall arrest safety anchorage device that is rigid enough to allow reuse after the removal in a previous installation.

A yet further object of the invention is to provide a new and improved fall arrest safety anchorage device that can be easily and inexpensively manufactured.

Further objects and advantages of the invention will become apparent from a consideration of the drawings and ensuing description.

DETAILED DESCRIPTION OF THE INVENTION

Figure 1:
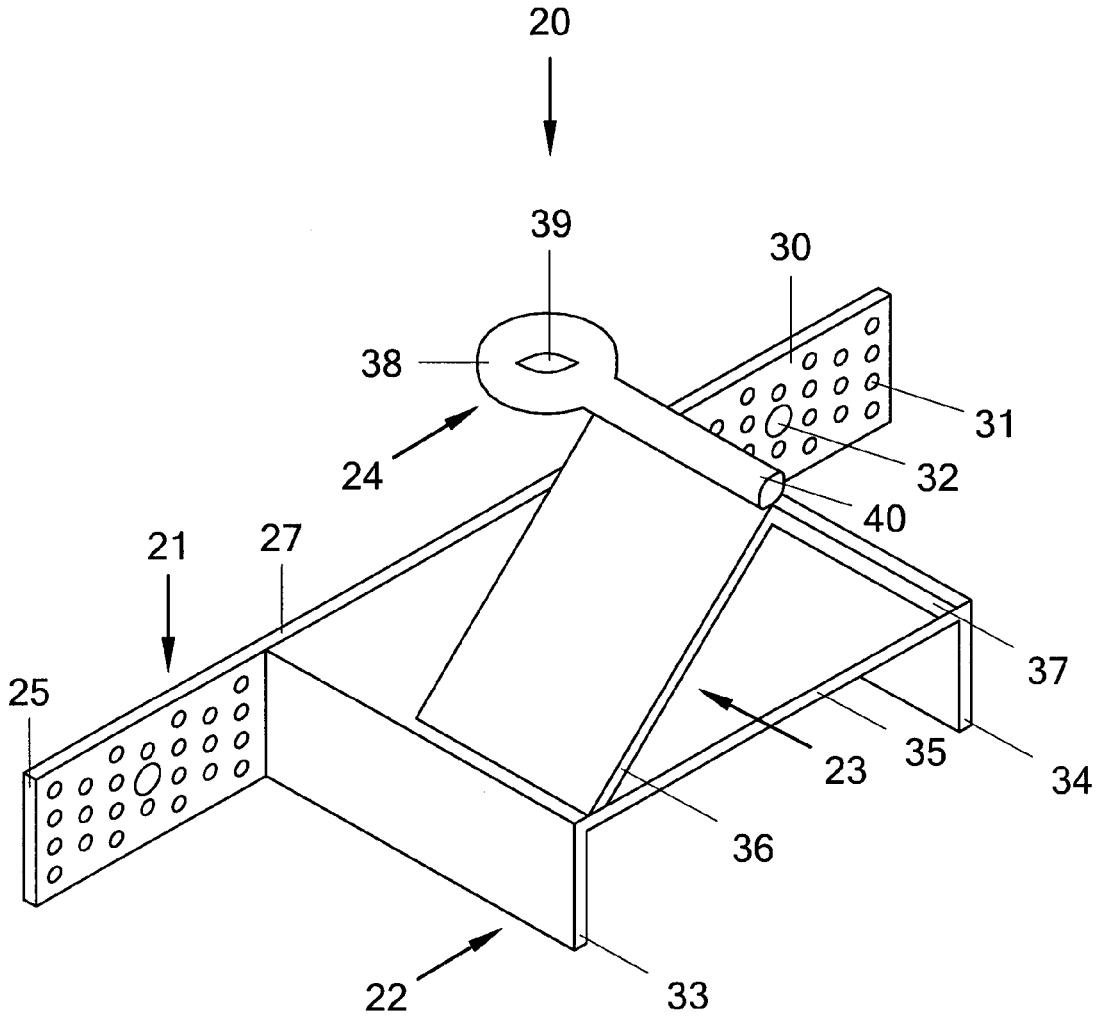
FIG. 1 is a top-right-rear isometric view of the present invention.

In the following description, like parts are marked throughout the specification and drawing figures with the same reference numerals, respectively. The drawing figures are not necessarily to scale and certain features may be shown in somewhat a generalized form in the interest of clarity.

Figure 2:
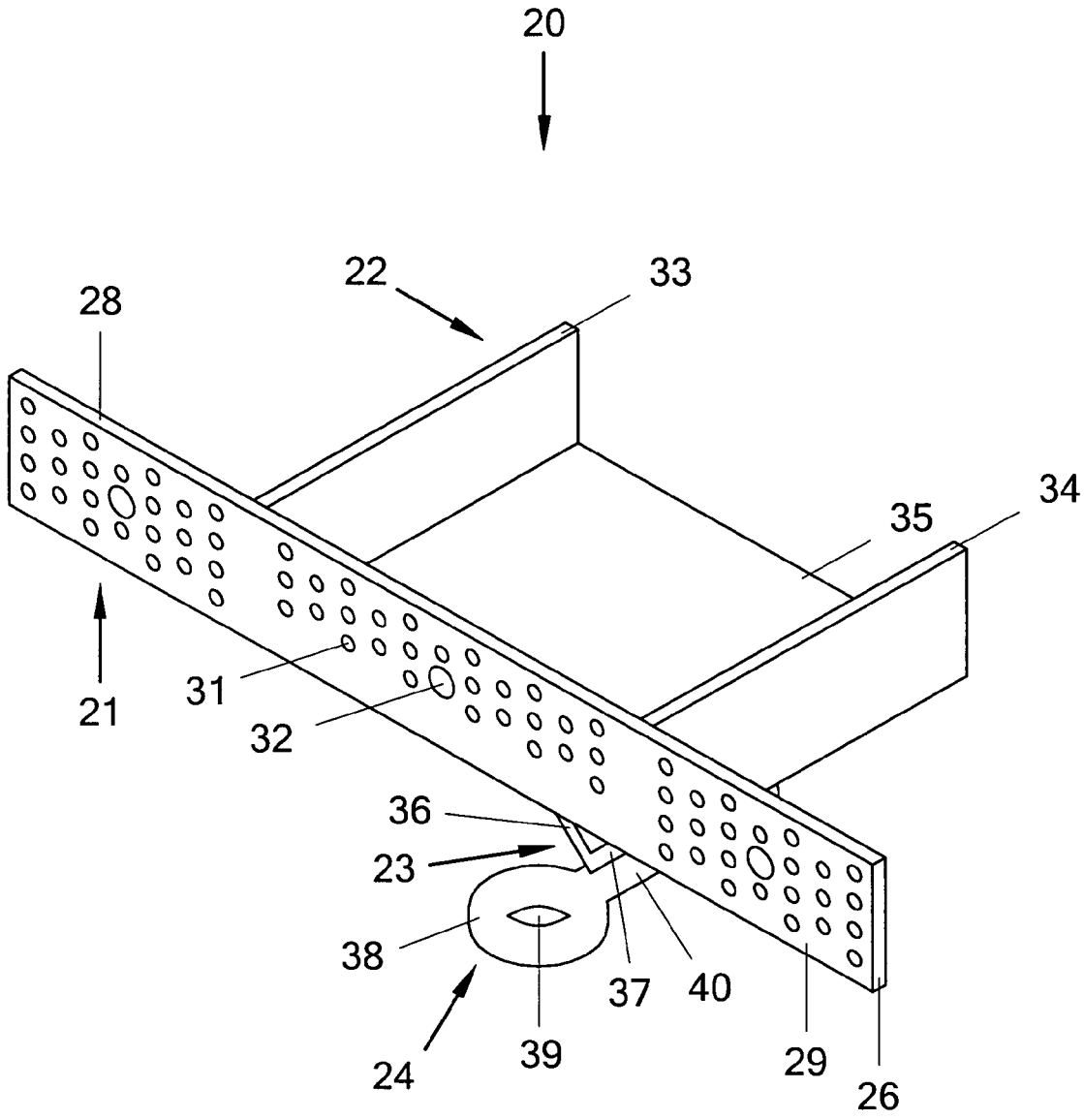
FIG. 2 is a bottom-left-front isometric view of the present invention.

Referring now to FIG. 1 and FIG. 2, there is shown a fall arrest safety anchorage device constructed according to the teachings of the present invention, the fall arrest safety anchorage device being generally indicated by the reference numeral 20. As will be described further in detail below, the fall arrest safety anchorage device 20 is designed for use in receiving and securing fall arrest safety equipment.

It should be noted that the Occupational Safety and Health Administration standard 1926.502 (Year of 2004) stipulates that anchorages used for the attachment of personal fall arrest equipment shall be capable of supporting at least five thousand pounds per employee attached and shall be installed under the supervision of a qualified person. With the aid of fastening devices (such as screws, nails, bolts, rivets, and other similar fastening devices), the fall arrest safety anchorage device 20 can be removably secured to a wide variety of vertical, horizontal, or inclined rigid planar substrates and meet the previously mentioned Occupational Safety and Health Administration's five thousand pound support requirement. However, a fall arrest safety system failure can occur if the mounting substrate and fastening devices are not strong enough to support a load of five thousand pounds. Selecting an appropriate mounting substrate for the fall arrest safety anchorage device 20 and selecting appropriate fastening devices for removably securing the fall arrest safety anchorage device 20 to a desired mounting substrate shall be apparent to those skilled in the art, and should only be selected by a "qualified person" (as defined by government regulations), and is beyond the scope of the present teachings. For exemplary purposes only, the fall arrest safety anchorage device 20 will be shown in various drawing figures being positioned adjacent to various surface portions of a wooden gable framed building structure. Mounting the fall arrest safety anchorage device 20 to these exemplary surfaces should only be attempted under the supervision of a "qualified person" and in no way does this present teaching represent that the exemplary surfaces described herein are rigid enough to support a load of five thousand pounds. The wooden gable framed building structure was chosen for exemplary purposes because of the shape and various surface portions to clearly demonstrate the usefulness of the fall arrest safety anchorage device 20 and to describe various positioning of the fall arrest safety anchorage device 20 to achieve a variety of fall arrest safety system setups. However, it is to be understood, the fall arrest safety anchorage device 20 can be removably secured to alternative surfaces without departing from the spirit of the present invention. Specifically, as previously mentioned, the fall arrest safety anchorage device 20 can be removably secured to a wide variety of vertical, horizontal, or inclined rigid planar substrates, providing a selected mounting substrate is rigid enough to support a load of five thousand pounds. Fastening devices have been omitted from the exemplary drawing figures because the drawing figures are intended only to provide possible safety configurations, however, it is to be understood, the fall arrest safety anchorage device 20 must be removably secured to a selected mounting substrate with screws, nails, bolts, rivets, or other similar fastening devices, or a combination of these fastening devices, to meet the Occupational Safety and Health Administration's five thousand pound support requirement. Furthermore, it is also to be understood that the fall arrest safety anchorage device 20 is generally constructed of metal and can be attached by welding or similar processes to planar metal substrates large enough to accommodate mounting of the fall arrest safety anchorage device 20 and rigid enough to meet the Occupational Safety and Health Administration's five thousand pound support requirement.

The fall arrest safety anchorage device 20 is generally shown having a mounting plate 21, a first positioning member 22, a second positioning member 23, and a safety equipment receiving member 24.

The mounting plate 21 is generally of a planar rectangular form, having a right end 25, a left end 26, a top edge 27, a bottom edge 28, a front face 29, and a rear face 30. The mounting plate 21 has a plurality of predetermined first diameter mounting apertures 31 for receiving fasteners which pass through the front face 29 and the rear face 30, and a plurality of predetermined second diameter mounting apertures 32 for receiving fasteners which also pass through the front face 29 and the rear face 30. The mounting plate 21 is constructed from and conventionally known to one skilled in the art as flat bar.

The first positioning member 22 is generally of an open C-shape form including a pair of spaced apart and parallel flanges 33, 34 of equal width, interconnected by a web 35 having an upper web surface and a lower web surface, and having a front end and a rear end. The C-shaped first positioning member 22 is constructed from and conventionally known to one skilled in the art as channel.

The second positioning member 23 is generally of an open L-shape form including a pair of legs 36, 37 of equal length, which are interconnected and both originating from a common apex point to form a right angle, and having a front end and a rear end. The L-shaped second positioning member 23 is constructed from and conventionally known to one skilled in the art as angle.

The safety equipment receiving member 24 is generally an eyebolt, having an eyelet portion 38 with a receiving aperture 39 and an interconnected shank portion 40. The eyelet portion 38 of the safety equipment receiving member 24 has a predetermined inner diameter dimension and a predetermined outer diameter dimension. The shank portion 40 of the safety equipment receiving member 24 has a predetermined shank length. The safety equipment receiving member 24 has a predetermined overall length that can be obtained by adding the predetermined outer diameter dimension of the eyelet portion 38 and the predetermined shank length. The safety equipment receiving member 24 is conventionally known to one skilled in the art as an eyebolt blank, which refers to an eyebolt that has no external threads on the shank portion 40.

Figure 3:
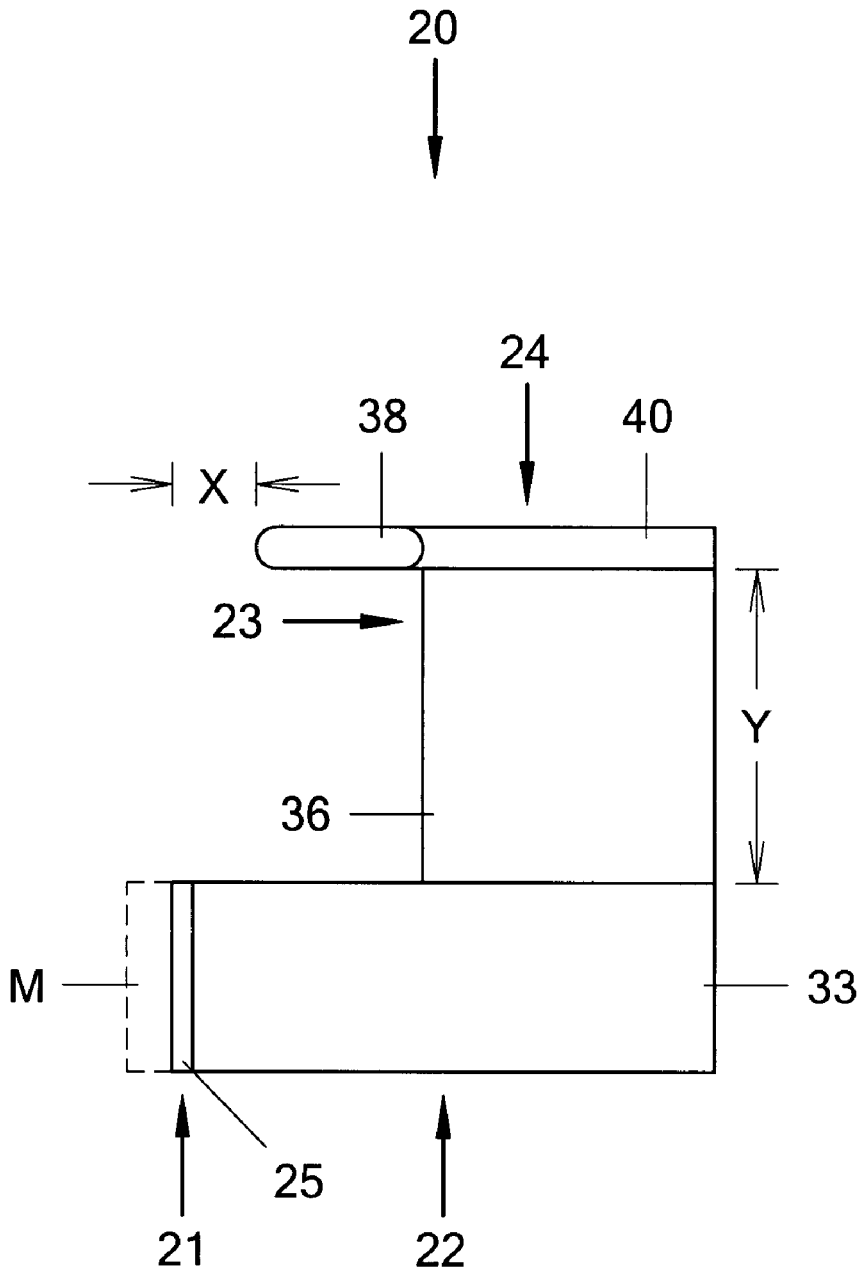
FIG. 3 is a right side view of the present invention.

Referring now to FIG. 1, FIG. 2, and FIG. 3, there are two critical measurements that must be considered when determining the dimensions of the various components of the fall arrest safety anchorage device 20. A predetermined planar parallel clearance X measurement and a predetermined planar perpendicular clearance Y measurement must first be established. The following example will help provide a better understanding of these critical measurements and the invention. Assume there is a first vertical plane, and on this first vertical plane there is a first point. A six inch first line segment extends from the first point and is perpendicular to the first vertical plane. At the other end of the line segment, there is a second point and there is a second vertical plane being parallel to the first vertical plane. The clearance between the first vertical plane and the second vertical plane is six inches. The predetermined planar parallel clearance X measurement would be six inches. Now there is a four inch second line segment with one end attaching to the second point and being perpendicular to the first line segment, and being on the second vertical plane and extending upward. At the unattached end of the second line segment, there is a third point and a first horizontal plane. By placing a second horizontal plane being parallel with the first horizontal plane at the first point, a clearance of four inches is proven between the first horizontal plane and the second horizontal plane. The predetermined planar perpendicular clearance Y measurement would be four inches. It is noteworthy to mention that it is perpendicular clearance because the first point lies on the first vertical plane, and the first horizontal plane is perpendicular to the first vertical plane. To gain a better understanding of the present invention, the proceeding example will be applied to the components comprising the invention. The purpose of the planar mounting plate 21 is to enable securing of the fall arrest safety anchorage device 20 to a planar mounting surface area M, however for the sake of example, think of the mounting plate 21 as the first point. The purpose of the C-shaped first positioning member 22 is to extend perpendicularly from the planar mounting plate 21 to obtain the predetermined planar parallel clearance X from the planar mounting surface area M and to allow the attachment of the L-shaped second positioning member 23. However, for the sake of example, think of the C-shaped first positioning member 22 as the first line segment. The purpose of the L-shaped second positioning member 23 is to extend perpendicularly from the upper web surface of the web 35 of the C-shaped first positioning member 22 to obtain the predetermined planar perpendicular clearance Y from the planar mounting surface area M. However, for the sake of example, think of the L-shaped second positioning member 23 as the second line segment. The purpose of the safety equipment receiving member 24 is to receive and secure fall arrest safety equipment. However, for the sake of example, think of the safety equipment receiving member 24 as the third point. Now in other terms, attach the planar mounting plate 21 to the first point. Then attach the C-shaped first positioning member 22 to the planar mounting plate 21 and extend the C-shaped first positioning member 22 to the second point. Then attach the L-shaped second positioning member 23 to the C-shaped first positioning member 22 and extend the L-shaped second positioning member 23 to the third point. Finally attach the safety equipment receiving member 24 to the L-shaped second positioning member 23 at the third point. If the fall arrest safety anchorage device 20 were simply comprised of points and line segments, there would be a means of securing safety equipment at a point which would be six inches outward and four inches upward from the initial mounting position, which has many benefits.

As previously mentioned, the predetermined planar parallel clearance X measurement and the predetermined planar perpendicular clearance Y measurement must be considered when determining the dimensions of the various components. Of these two measurements, the predetermined planar perpendicular clearance Y measurement is the most critical, because most of the other dimensions will depend upon the specification of this measurement. To obtain the predetermined planar perpendicular clearance Y measurement with structural integrity, the present invention utilizes the L-shaped second positioning member 23. The legs 36, 37 of the L-shaped second positioning member 23 have a predetermined width dimension, which is determined as follows. The predetermined planar perpendicular clearance Y measurement is squared, then multiplied by two, and then the square root of this number is acquired. The legs 36, 37 of the L-shaped second positioning member 23 also have a predetermined thickness that must be subtracted from the previously acquired square root to obtain the final width dimension of the legs 36, 37. The L-shaped second positioning member 23 also has a predetermined length generally equal to the predetermined planar perpendicular clearance Y measurement. The safety equipment receiving member 24 should have a minimum five thousand pound rated load capacity and the shank portion 40 of the safety equipment receiving member 24 has a predetermined length generally equal to the predetermined length of the L-shaped second positioning member 23. The web 35 of the C-shaped first positioning member 22 has a predetermined depth dimension which is slightly larger than the predetermined planar perpendicular clearance Y measurement multiplied by two. The C-shaped first positioning member 22 has a predetermined length. To acquire the length dimension of the C-shaped first positioning member 22, the predetermined planar parallel clearance X measurement must first be established. After determining the predetermined planar parallel clearance X measurement, the length dimension of the C-shaped first positioning member 22 is determined by adding the overall length of the safety equipment receiving member 24 to the predetermined planar parallel clearance X measurement, and then the mounting plate 21 has a predetermined thickness which must be subtracted. The flanges 33, 34 of the C-shaped first positioning member 22 have a predetermined width generally equal to one third of the length of the C-shaped first positioning member 22. The mounting plate 21 has a predetermined width as measured from the top edge 27 to the bottom edge 28. The predetermined width of the mounting plate 21 is generally equal to the width of the flanges 33, 34 of the C-shaped first positioning member 22. The mounting plate 21 also has a predetermined length as measured from the right end 25 to the left end 26 which is generally equal to the predetermined width of the web 35 of the C-shaped first positioning member 22 multiplied by three.

As viewed by the human eye, the bottom edge 28 of the mounting plate 21 lies on a horizontal plane. The flanges 33, 34 of the C-shaped first positioning member 22 are projecting downwardly from the web 35 and lie on the same horizontal plane as the bottom edge 28 of the mounting plate 21. The front end of the C-shaped first positioning member 22 is adjacent to the rear face 30 of the mounting plate 21, with the longitudinal axis of the C-shaped first positioning member 22 being perpendicular to the longitudinal axis of the mounting plate 21 and with the longitudinal axis of the C-shaped first positioning member 22 being on the same horizontal plane as the longitudinal axis of the mounting plate 21. The C-shaped first positioning member 22 is permanently attached to the mounting plate 21 by a seam weld or similar adhesion method. The legs 36, 37 of the L-shaped second positioning member 23 are adjacent to the upper web surface of the web 35 of the C-shaped first positioning member 22, with the longitudinal axis of the L-shaped second positioning member 23 being parallel with the longitudinal axis of the C-shaped first positioning member 22 and with the longitudinal axis of the L-shaped second positioning member 23 being on the same vertical plane as the longitudinal axis of the C-shaped first positioning member 22. The rear end of the L-shaped second positioning member 23 and the rear end of the C-shaped first positioning member 22 lie on the same vertical plane. The L-shaped second positioning member 23 is permanently attached to the C-shaped first positioning member 22 by a seam weld or similar adhesion method. The L-shaped second positioning member 23 has a longitudinal apex formed by the interconnection of the legs 36, 37. The shank portion 40 of the safety equipment receiving member 24 is adjacent to the longitudinal apex of the L-shaped second positioning member 23 with the eyelet portion 38 of the safety equipment receiving member 24 projecting forwardly past the front end of the L-shaped second positioning member 23. The longitudinal axis of the safety equipment receiving member 24 is parallel with the longitudinal axis of the L-shaped second positioning member 23 and the longitudinal axis of the safety equipment receiving member 24 lies on the same vertical plane as the longitudinal axis of the L-shaped second positioning member 23. The eyelet portion 38 of the safety equipment receiving member 24 being further positioned to be parallel with the top edge 27 of the mounting plate 21. The shank portion 40 of the safety equipment receiving member 24 is permanently attached to the L-shaped second positioning member 23 by a seam weld or similar adhesion method.

Referring now to FIG. 4, FIG. 5, FIG. 6, FIG. 7, FIG. 8, and FIG. 9, as previously mentioned, for exemplary purposes only, the fall arrest safety anchorage device 20 will be shown in various drawing figures being positioned adjacent to various surface portions of a wooden gable framed building structure and it will also be described being positioned adjacent to various surface portions of a wooden gable framed building structure. The exemplary structure has a planar north wall 41, a planar east wall 42, a planar south wall (not shown), and a planar west wall (not shown). The north wall 41 and the south wall are the gable ends of the structure. The exemplary structure also has an inclined planar east roofing portion 43 and an inclined planar west roofing portion 44, which are interconnected and both originating from a common apex point. The apex is an elongated apex and is conventionally known to one skilled in the art as a ridge 45. The north wall 41, the east wall 42, the inclined east roofing portion 43, the inclined west roofing portion 44, and the ridge 45 are generally referenced throughout the drawing figures to indicate surface or position, and some construction materials may be on the same plane as the indicated surface or position. Construction materials will have different reference numerals than indicated surfaces or positions when existing on similar planes.

Figure 4:
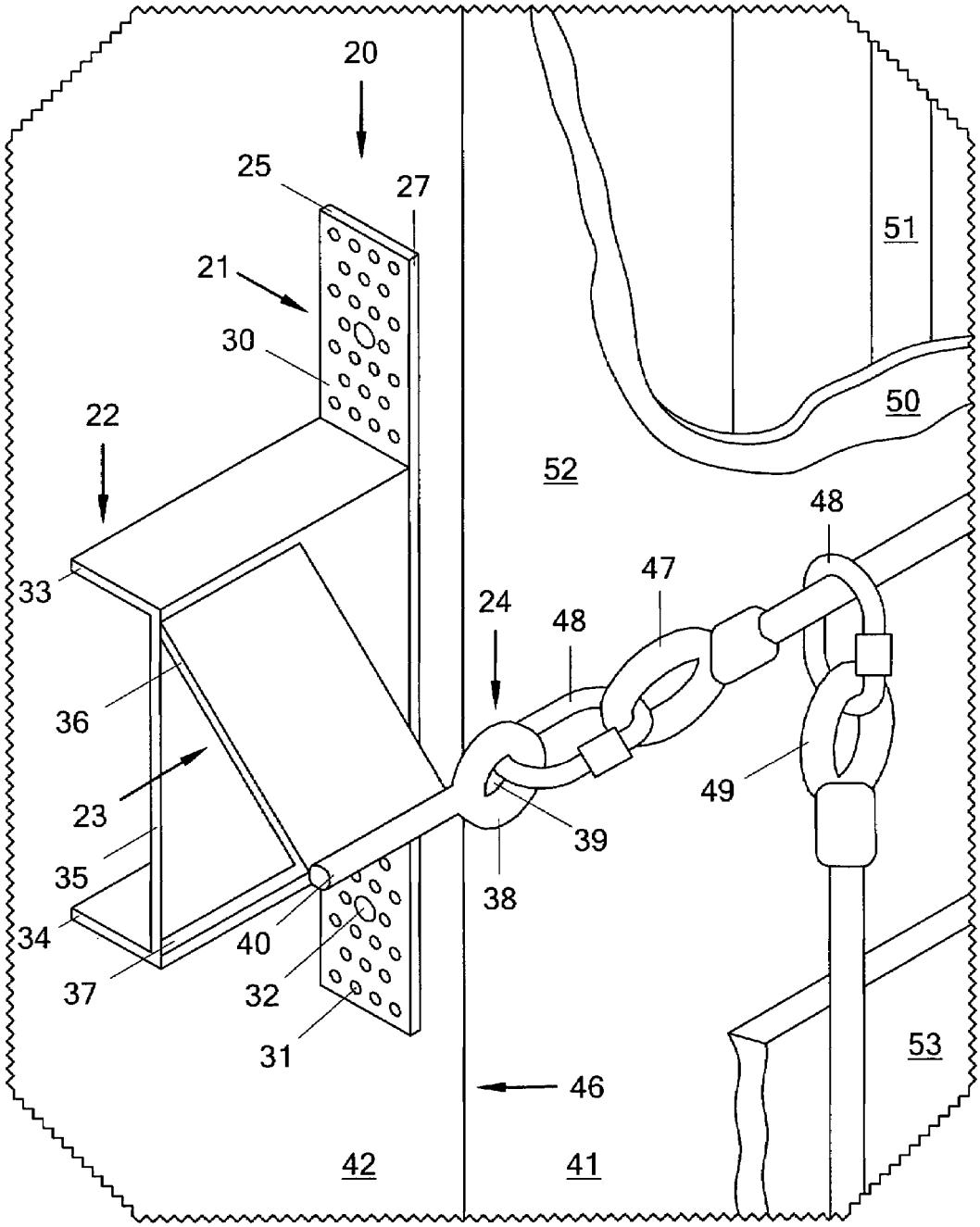
FIG. 4 is a fragmentary isometric in-use view of the present invention positioned adjacent to a corner of a wooden gable framed building structure, depicting the attachment of a horizontal lifeline to the present invention, with a vertical lifeline attached to the horizontal lifeline.

Referring now to FIG. 4, the fall arrest safety anchorage device 20 is shown in close proximity of a northeast corner 46 of the exemplary structure, with the northeast corner 46 being generally indicated. The fall arrest safety anchorage device 20 is shown with the mounting plate 21 adjacent to the east wall 42 of the exemplary structure. The top edge 27 of the mounting plate 21 is shown being on a vertical plane and facing northward. The fall arrest safety anchorage device 20 being further positioned in a manner that the safety equipment receiving member 24 is extended past the northeast corner 46 for a predetermined distance. A horizontal lifeline 47 (a safety rope or cable positioned on a horizontal plane) is removably secured to the safety equipment receiving member 24 of the fall arrest safety anchorage device 20 with the aid of a carabiner 48. The horizontal lifeline 47 has a swaged loop end with an aperture. The carabiner 48 is shown passing through the aperture of the swaged loop end of the horizontal lifeline 47 and passing through the receiving aperture 39 of the eyelet portion 38 of the safety equipment receiving member 24. The horizontal lifeline 47 is extended westward on a horizontal plane to another fall arrest safety anchorage device 20 (not shown) being in close proximity of a northwest corner (not shown) of the exemplary structure. Although not shown, the fall arrest safety anchorage device 20 would be positioned with the mounting plate 21 adjacent to the west wall of the exemplary structure. The top edge 27 of the mounting plate 21 would be on a vertical plane and facing northward. The fall arrest safety anchorage device 20 would be further positioned in a manner that the safety equipment receiving member 24 would be extended past the northwest corner for a predetermined distance. The horizontal lifeline 47 would be removably secured to the safety equipment receiving member 24 of the fall arrest safety anchorage device 20 located in close proximity of the northwest corner with the aid of another carabiner 48 or lifeline tensioning device (not shown). A vertical lifeline 49 (a safety rope or cable positioned on a vertical plane) is removably secured to the horizontal lifeline 47 with the aid of another carabiner 48 in the following manner. The vertical lifeline 49 has a swaged loop end with an aperture. The carabiner 48 is shown passing through the aperture of the swaged loop end of the vertical lifeline 49 and encircling the horizontal lifeline 47. The vertical lifeline 49 is projecting downward from the horizontal lifeline 47. The horizontal lifeline 47, the vertical lifeline 49, the safety equipment receiving member 24 of the fall arrest safety anchorage device 20 located in close proximity of a northeast corner, and the safety equipment receiving member 24 of the fall arrest safety anchorage device 20 located in close proximity of a northwest corner, are all substantially on a common vertical plane. There is a horizontal distance between the common vertical plane and the north wall 41, which was established by the predetermined distance that the safety equipment receiving members 24 extended past the two corners. As shown in FIG. 4, there is a portion of plywood wall sheathing 50 adjacent to a wooden construction wall stud 51, and adjacent to the portion of plywood wall sheathing 50 is a portion of thermal vapor barrier membrane 52, and adjacent to the portion of thermal vapor barrier membrane 52 is a portion of wooden structural siding 53. This type of fall arrest safety system setup permits construction workers to move freely, both horizontally and vertically near a vertical surface. As a result of this type of fall arrest safety system setup and the established horizontal distance, construction workers secured to the horizontal lifeline 47 and/or the vertical lifeline 49 could safely install most, if not all, of the previously mentioned construction materials on the vertical surface of the north wall 41, without removing the safety equipment. The appropriate securing of workers to the horizontal lifeline 47 and/or the vertical lifeline 49 shall be apparent to those skilled in the art. It is noteworthy to mention that the horizontal distance is actually made possible by the predetermined planar perpendicular clearance Y measurement discussed earlier in this teaching.

Figure 5:
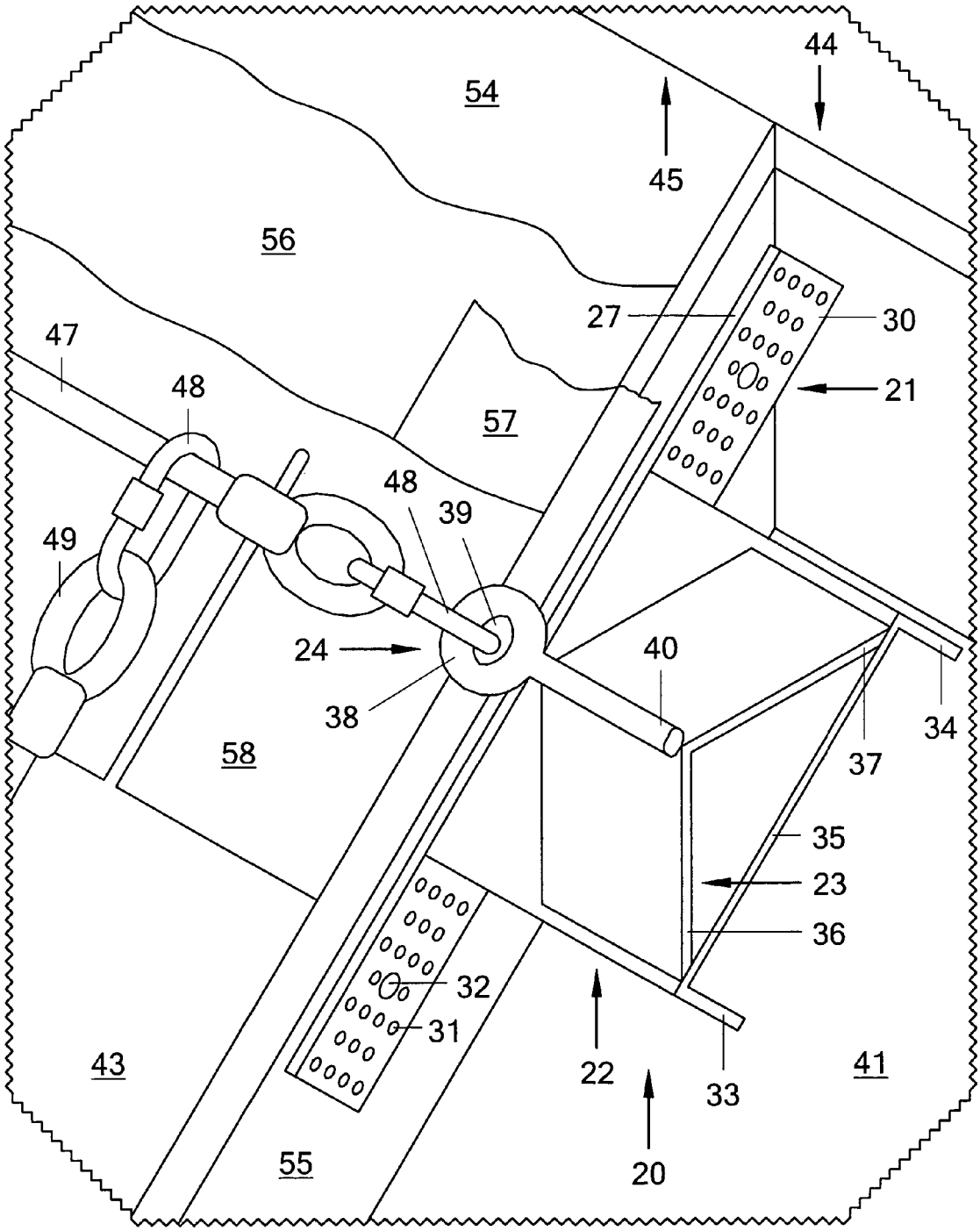
FIG. 5 is a fragmentary isometric in-use view of the present invention positioned adjacent to a portion of a rafter's surface of a wooden gable framed building structure, depicting the attachment of a horizontal lifeline to the present invention, with a vertical lifeline attached to the horizontal lifeline.

Referring now to FIG. 5, one of the previously mentioned fall arrest safety anchorage devices 20 is now shown in close proximity of the ridge 45 and the north wall 41 of the exemplary structure. The inclined east roofing portion 43 of the exemplary structure is shown having a layer of roof sheathing 54. The fall arrest safety anchorage device 20 is shown with the mounting plate 21 adjacent to a planar side face of an inclined rafter or fascia board 55 at the gable end of the north wall 41, with the side face of the inclined rafter or fascia board 55 facing the north and the eyelet portion 38 of the safety equipment receiving member 24 projecting southward. The fall arrest safety anchorage device 20 is further positioned in a manner that the top edge 27 of the mounting plate 21 is below the layer of roof sheathing 54 at a predetermined distance, the top edge 27 of the mounting plate 21 matches the angle of the roofing pitch, and the longitudinal axis of the shank portion 40 of the safety equipment receiving member 24 is at a predetermined distance from the ridge 45. And the fall arrest safety anchorage device 20 is even further positioned in a manner that the safety equipment receiving member 24 would be extended above the layer of roof sheathing 54 for a predetermined distance. The previously mentioned horizontal lifeline 47 is now removably secured to the safety equipment receiving member 24 of the fall arrest safety anchorage device 20 with one of the previously mentioned carabiners 48. The carabiner 48 is shown passing through the aperture of the swaged loop end of the horizontal lifeline 47 and passing through the receiving aperture 39 of the eyelet portion 38 of the safety equipment receiving member 24. The horizontal lifeline 47 is extended southward on a horizontal plane to another fall arrest safety anchorage device 20 (not shown) being at the gable end of the south wall of the exemplary structure. Although not shown, the fall arrest safety anchorage device 20 would be positioned with the mounting plate 21 adjacent to a planar side face of another inclined rafter or fascia board 55 at the gable end of the south wall, with the side face of the inclined rafter or fascia board 55 facing the south and the eyelet portion 38 of the safety equipment receiving member 24 projecting northward. The fall arrest safety anchorage device 20 would be further positioned in a manner that the top edge 27 of the mounting plate 21 would be below the layer of roof sheathing 54 at a predetermined distance, the top edge 27 of the mounting plate 21 would match the angle of the roofing pitch, and the longitudinal axis of the shank portion 40 of the safety equipment receiving member 24 would be at a predetermined distance from the ridge 45. And the fall arrest safety anchorage device 20 would be even further positioned in a manner that the safety equipment receiving member 24 would be extended above the layer of roof sheathing 54 for a predetermined distance. The horizontal lifeline 47 would be removably secured to the safety equipment receiving member 24 of the fall arrest safety anchorage device 20 located at the gable end of the south wall with the aid of another carabiner 48 or lifeline tensioning device (not shown). The previously mentioned vertical lifeline 49 is now removably secured to the horizontal lifeline 47 with the aid of another carabiner 48 in the following manner. The carabiner 48 is shown passing through the aperture of the swaged loop end of the vertical lifeline 49 and encircling the horizontal lifeline 47. The vertical lifeline 49 is projecting downward from the horizontal lifeline 47 along the inclined surface of the east roofing portion 43. The horizontal lifeline 47, the safety equipment receiving member 24 of the fall arrest safety anchorage device 20 located at the gable end of the north wall 41, and the safety equipment receiving member 24 of the fall arrest safety anchorage device 20 located at the gable end of the south wall, are all substantially on a common vertical plane and are all substantially on a common horizontal plane. There is a vertical distance between the common horizontal plane and the inclined east roofing portion 43, which was established by the predetermined distance that the safety equipment receiving members 24 extended above the layer of roof sheathing 54. As shown in FIG. 5, adjacent to the layer of roof sheathing 54 is a layer of roofing felt paper 56, and adjacent to the layer of roofing felt paper 56 is a strip of roofing drip edge 57, and adjacent to the strip of roofing drip edge 57 is a layer of asphalt roofing shingles 58. This type of fall arrest safety system setup permits construction workers to move freely, both horizontally and vertically on an inclined surface. As a result of this type of fall arrest safety system setup and the established vertical distance, construction workers secured to the horizontal lifeline 47 and/or the vertical lifeline 49 could safely install most, if not all, of the previously mentioned construction materials on the inclined east roofing portion 43, without removing the safety equipment. It is noteworthy to mention that the vertical distance is actually made possible by the predetermined planar perpendicular clearance Y measurement discussed earlier in this teaching.

Figure 6:
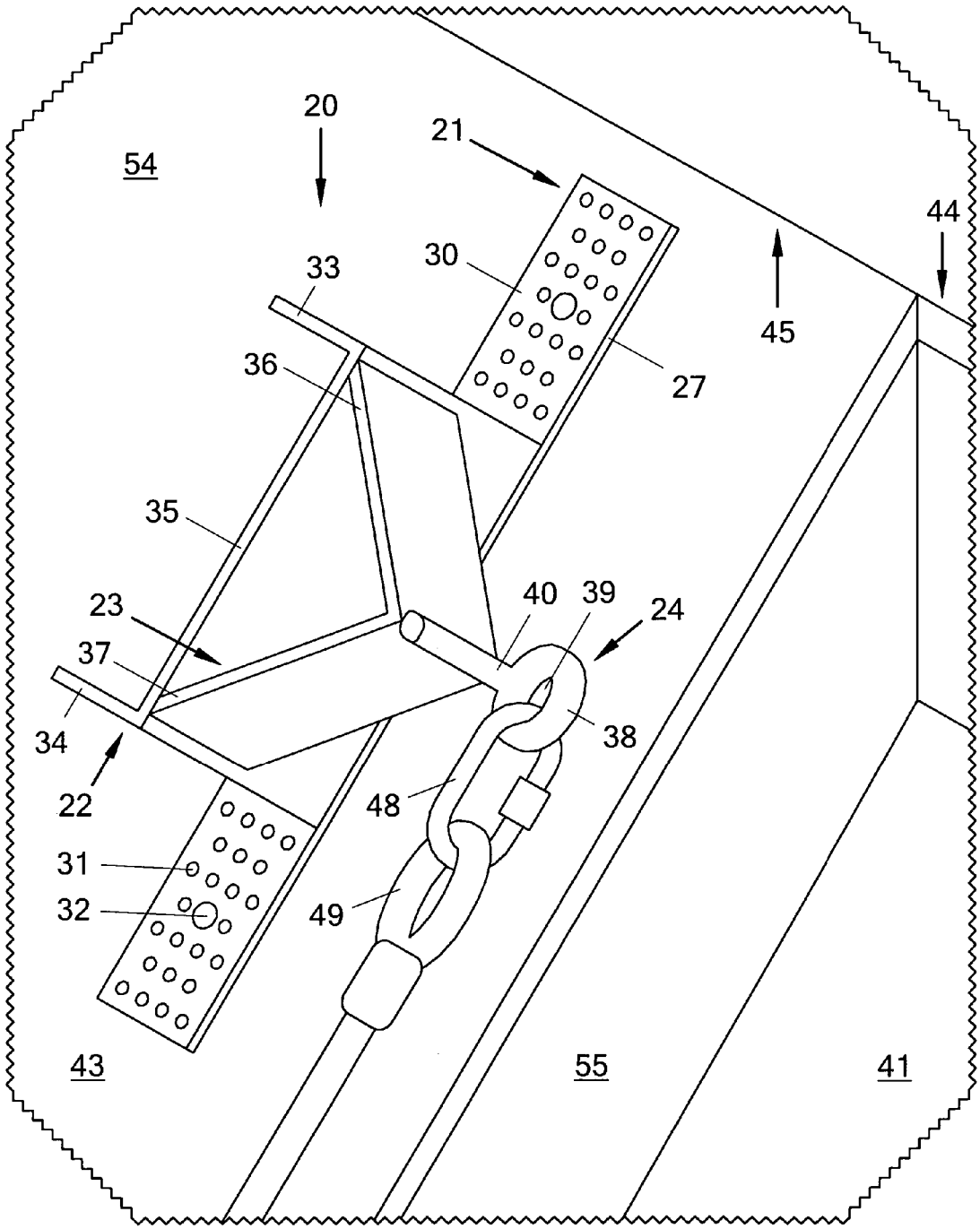
FIG. 6 is a fragmentary isometric in-use view of the present invention positioned adjacent to a portion of a roof's surface of a wooden gable framed building structure, depicting the attachment of a vertical lifeline to the present invention.

Referring now to FIG. 6, one of the previously mentioned fall arrest safety anchorage devices 20 is now shown in close proximity of the ridge 45 and the north wall 41 of the exemplary structure. The fall arrest safety anchorage device 20 is positioned with the mounting plate 21 adjacent to the planar inclined east roofing portion 43 of the exemplary structure, the top edge 27 of the mounting plate 21 is facing northward, and the eyelet portion 38 of the safety equipment receiving member 24 projecting toward the planar inclined east roofing portion 43 surface. The previously mentioned vertical lifeline 49 is now removably secured to the safety equipment receiving member 24 of the fall arrest safety anchorage device 20 with one of the previously mentioned carabiners 48. The carabiner 48 is shown passing through the aperture of the swaged loop end of the vertical lifeline 49 and passing through the receiving aperture 39 of the eyelet portion 38 of the safety equipment receiving member 24. The vertical lifeline 49 is extended downward along the inclined east roofing portion 43 surface. This type of fall arrest safety system setup permits construction workers to move vertically on an inclined surface. As a result of this type of fall arrest safety system setup, construction workers secured to the vertical lifeline 49 could safely perform many construction or service tasks.

Figure 7:
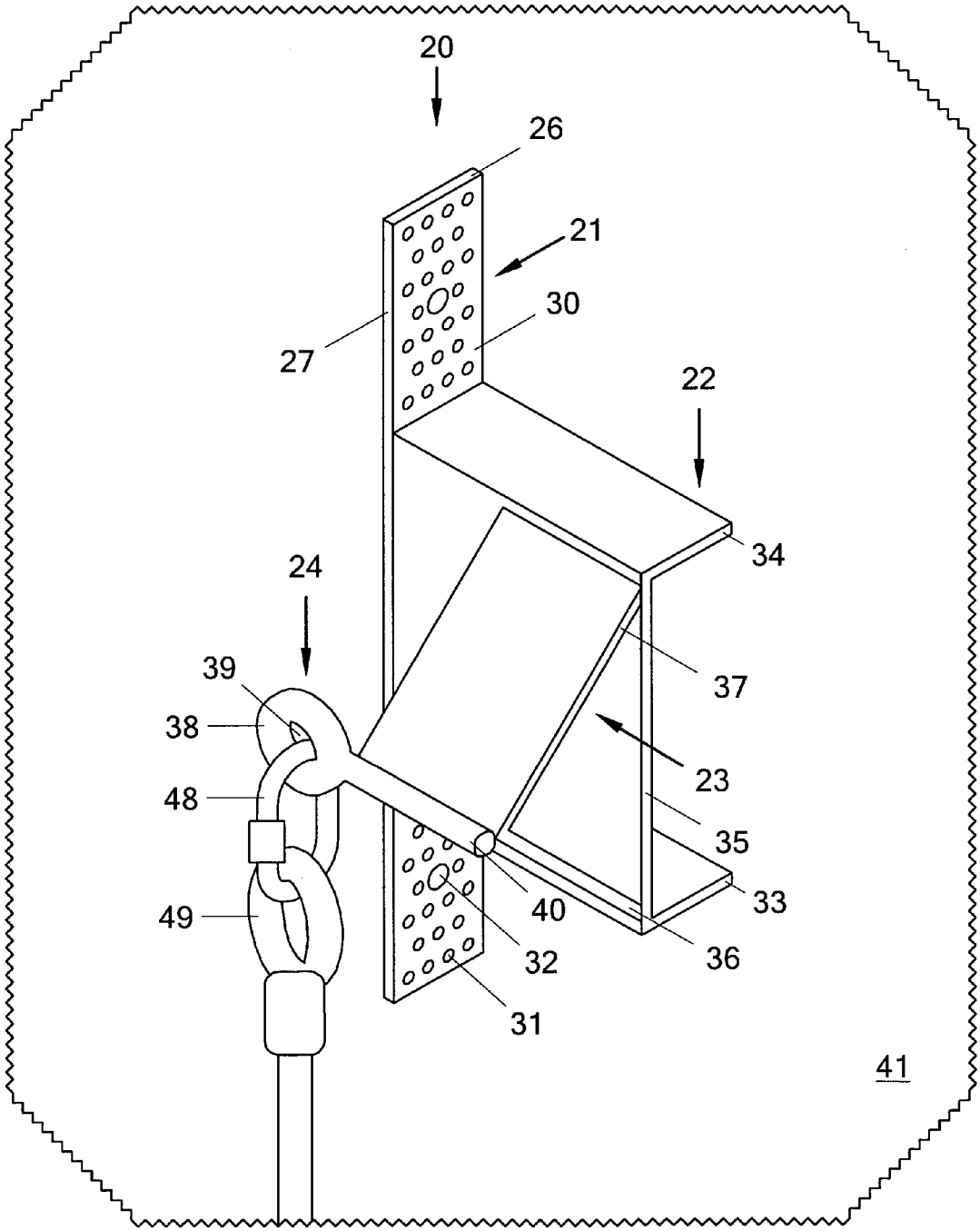
FIG. 7 is a fragmentary isometric in-use view of the present invention positioned adjacent to a portion of a wall's surface of a wooden gable framed building structure, depicting the attachment of a vertical lifeline to the present invention.

Referring now to FIG. 7, one of the previously mentioned fall arrest safety anchorage devices 20 is now shown with the mounting plate 21 adjacent to the north wall 41 of the exemplary structure, the top edge 27 of the mounting plate 21 facing eastward, and the eyelet portion 38 of the safety equipment receiving member 24 projecting toward the vertical planar surface of the north wall 41. The previously mentioned vertical lifeline 49 is now removably secured to the safety equipment receiving member 24 of the fall arrest safety anchorage device 20 with one of the previously mentioned carabiners 48. The carabiner 48 is shown passing through the aperture of the swaged loop end of the vertical lifeline 49 and passing through the receiving aperture 39 of the eyelet portion 38 of the safety equipment receiving member 24. The vertical lifeline 49 is projecting downward. This type of fall arrest safety system setup permits construction workers to move vertically near a vertical planar surface. As a result of this type of fall arrest safety system setup, construction workers secured to the vertical lifeline 49 could safely perform many construction or service tasks.

Figure 8:
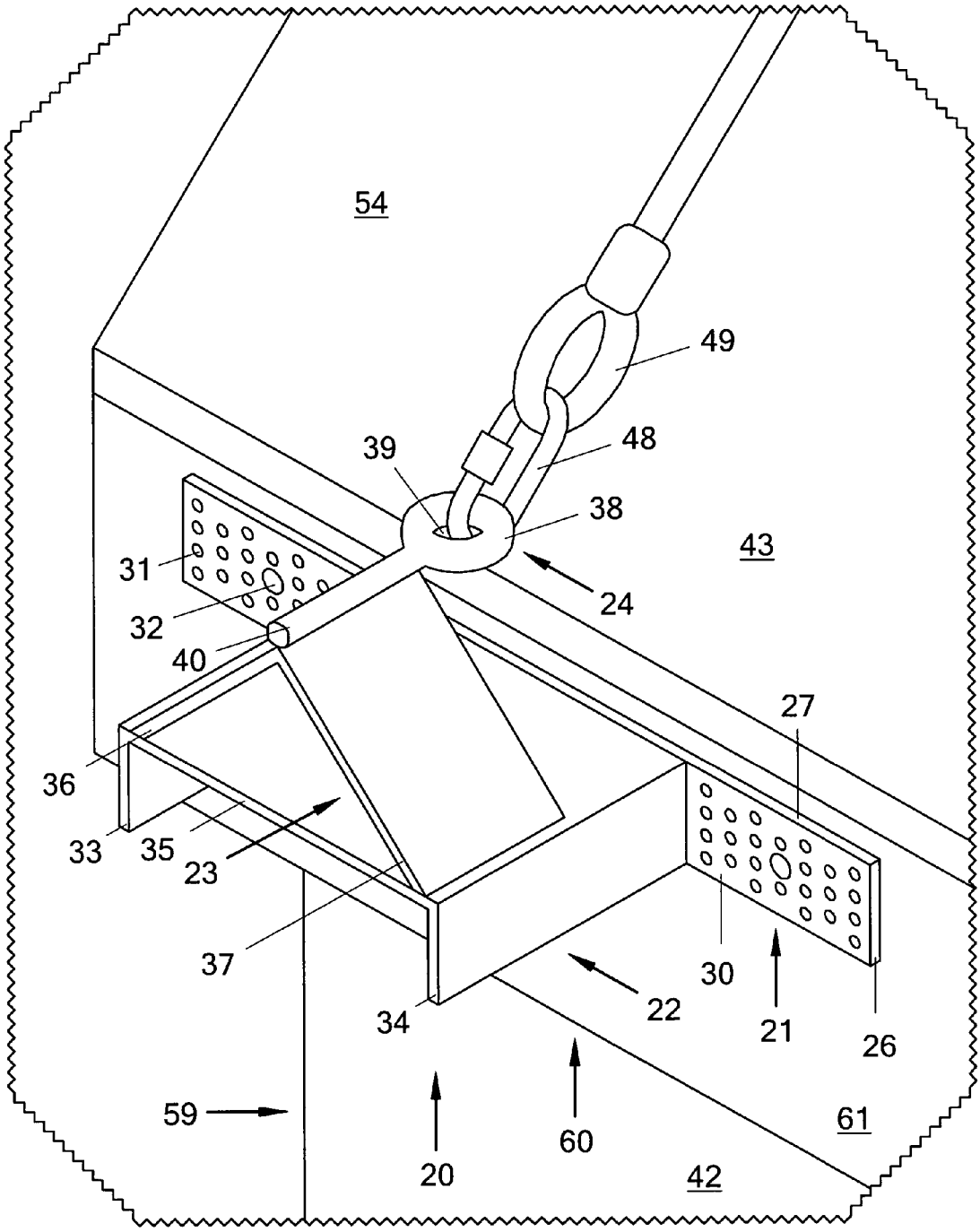
FIG. 8 is a fragmentary isometric in-use view of the present invention positioned adjacent to a portion of a fascia's surface of a wooden gable framed building structure, depicting the attachment of a vertical lifeline to the present invention.

Referring now to FIG. 8, one of the previously mentioned fall arrest safety anchorage devices 20 is now shown in close proximity of a southeast corner 59 of the exemplary structure, with the southeast corner 59 being generally indicated. It is also shown that the east wall 42 has an eave 60 as also generally indicated, with a fascia board 61 that runs north and south. The fall arrest safety anchorage device 20 is positioned with the mounting plate 21 adjacent to the planar vertical side face of the fascia board 61 which faces eastward, the top edge 27 of the mounting plate 21 facing upward, and the eyelet portion 38 of the safety equipment receiving member 24 projecting westward. The previously mentioned vertical lifeline 49 is now removably secured to the safety equipment receiving member 24 of the fall arrest safety anchorage device 20 with one of the previously mentioned carabiners 48. The carabiner 48 is shown passing through the aperture of the swaged loop end of the vertical lifeline 49 and passing through the receiving aperture 39 of the eyelet portion 38 of the safety equipment receiving member 24. The vertical lifeline 49 is projecting upward along the inclined east roofing portion 43 surface and although not shown, the vertical lifeline 49 continues up the inclined east roofing portion 43 surface until it crosses the ridge 45 and then it begins projecting downward along the inclined west roofing portion 44 until it reaches a predetermined point. This type of fall arrest safety system setup permits construction workers to move vertically on an inclined surface. As a result of this type of fall arrest safety system setup, construction workers secured to the vertical lifeline 49 could safely perform many construction or service tasks on an opposite side of an elongated apex from which the fall arrest safety anchorage device 20 is removably secured.

Figure 9:
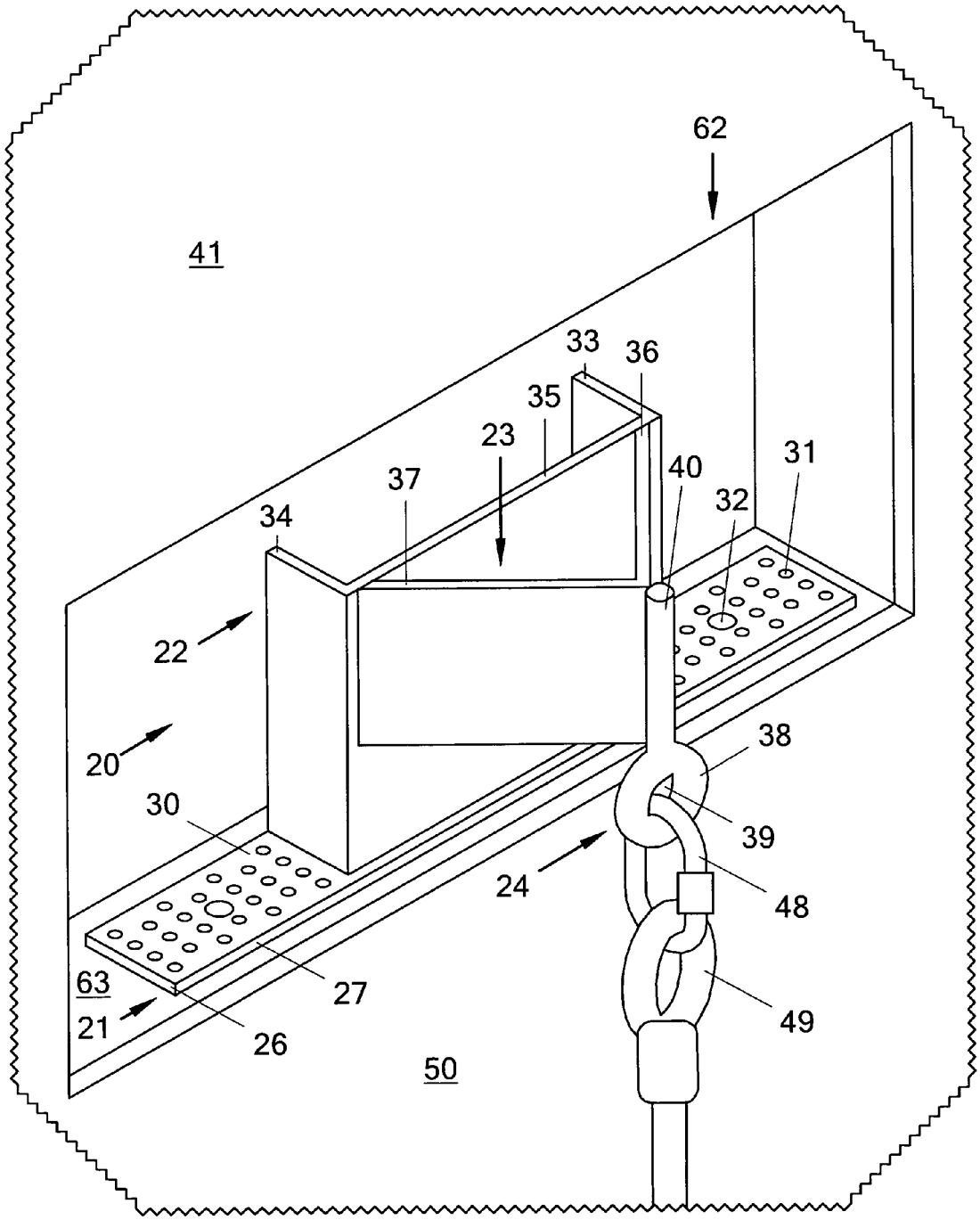
FIG. 9 is a fragmentary isometric in-use view of the present invention positioned adjacent to a portion of a rough sills surface within the rough opening of a window of a wooden gable framed building structure, depicting the attachment of a vertical lifeline to the present invention.

Referring now to FIG. 9, it is generally indicated that the exemplary structure has a rough opening for a window 62 with a rough sill 63 on the north wall 41. One of the previously mentioned fall arrest safety anchorage devices 20 is now shown with the mounting plate 21 adjacent to the planar side face of the rough sill 63, with the planar side face of the rough sill 63 facing upward. The fall arrest safety anchorage device 20 is further positioned in a manner that the top edge 27 of the mounting plate 21 is facing northward, and the eyelet portion 38 of the safety equipment receiving member 24 is projecting downward towards the earths surface. And the fall arrest safety anchorage device 20 is even further positioned in a manner that the safety equipment receiving member 24 would be extended past the plywood wall sheathing 50 for a predetermined distance. The previously mentioned vertical lifeline 49 is now removably secured to the safety equipment receiving member 24 of the fall arrest safety anchorage device 20 with one of the previously mentioned carabiners 48. The carabiner 48 is shown passing through the aperture of the swaged loop end of the vertical lifeline 49 and passing through the receiving aperture 39 of the eyelet portion 38 of the safety equipment receiving member 24. The vertical lifeline 49 is projecting downward. This type of fall arrest safety system setup permits construction workers to move vertically, near a vertical planar surface. As a result of this type of fall arrest safety system setup, construction workers secured to the vertical lifeline 49 could safely perform many construction or service tasks.

The above disclosure is not intended as limiting. Those skilled in the art will readily observe that numerous modifications and alterations of the device may be made while retaining the teachings of the invention, including the use of differently configured structural members besides the C-shaped first positioning member 22 and the L-shaped second positioning member 23 to achieve the predetermined planar parallel clearance X measurement and the predetermined planar perpendicular clearance Y measurement. Accordingly, the above disclosure should be construed as limited only by the restrictions of the appended claims.

I claim:

1. A fall arrest safety anchorage device made of metal for mounting on a rigid planar substrate comprising:

a mounting plate wherein said mounting plate has a planar mounting surface, a first positioning member wherein said first positioning member is angularly attached to said mounting plate at a predetermined first position and a predetermined first angle, a second positioning member wherein said second positioning member is angularly attached to said first positioning member at a predetermined second position and a predetermined second angle, and a safety equipment receiving member wherein said safety equipment receiving member is angularly attached to said second positioning member at a predetermined third position and a predetermined third angle, and said safety equipment receiving member is adapted to receive and to secure personal fall arrest safety equipment; and wherein said fall arrest safety anchorage device is secured to a planar surface mounting area of said rigid planar substrate by mounting means of said mounting plate such that said planar mounting surface of said mounting plate is adjacent to said planar surface mounting area and such that said first positioning member extends outward from said mounting plate and said planar surface mounting area, and said second positioning member extends outward from said first positioning member so that said safety equipment receiving member clears said planar surface mounting area by a predetermined planar parallel clearance as measured parallel to said planar surface mounting area and by a predetermined planar perpendicular clearance as measured perpendicular to said planar surface mounting area so that said safety equipment receiving member is at a desired location for receiving and securing personal fall arrest safety equipment.

2. The fall arrest safety anchorage device of claim 1, wherein said mounting plate is of a planar rectangular form.

3. The fall arrest safety anchorage device of claim 2, wherein said mounting plate has a plurality of predetermined first diameter mounting apertures for receiving fasteners.

4. The fall arrest safety anchorage device of claim 3, wherein said mounting plate has a plurality of predetermined second diameter mounting apertures for receiving fasteners.

5. The fall arrest safety anchorage device of claim 1, wherein said first positioning member is of an open C-shape form having a pair of spaced apart and parallel flanges interconnected by a web.

6. The fall arrest safety anchorage device of claim 5, wherein said first positioning member is attached to said mounting plate such that said first positioning member extends from said mounting plate at substantially a right angle.

7. The fall arrest safety anchorage device of claim 1, wherein said second positioning member is of an open L-shape form having a pair of legs being interconnected and originating from a common apex point.

8. The fall arrest safety anchorage device of claim 7, wherein said second positioning member is attached to said first positioning member such that said second positioning member extends from said first positioning member at substantially a right angle.

9. The fall arrest safety anchorage device of claim 1, wherein said safety equipment receiving member is an eyebolt, having an eyelet portion with a receiving aperture and an interconnected shank portion.

10. The fall arrest safety anchorage device of claim 9, wherein said safety equipment receiving member is attached to said second positioning member such that said safety equipment receiving member extends from said second positioning member at substantially a right angle.

11. The fall arrest safety anchorage device of claim 10, wherein said eyelet portion of said safety equipment receiving member projects toward the plane of said planar surface mounting area.

12. A fall arrest safety anchorage device made of metal for mounting on a rigid planar substrate comprising:

a mounting plate wherein said mounting plate is of a planar rectangular form, having a right end, a left end, a top edge, a bottom edge, a front face, and a rear face, a plurality of predetermined first diameter mounting apertures for receiving fasteners, and a plurality of predetermined second diameter mounting apertures for receiving fasteners, a first positioning member wherein said first positioning member is of an open C-shape form including a pair of spaced apart and parallel flanges of equal width, interconnected by a web having an upper web surface and a lower web surface, said first positioning member also having a front end and a rear end, said flanges of said first positioning member are projecting downwardly from said web and resting on a common horizontal plane with said bottom edge of said mounting plate, said front end of said first positioning member is adjacent to said rear face of said mounting plate, with the longitudinal axis of said first positioning member being perpendicular to the longitudinal axis of said mounting plate and with the longitudinal axis of said first positioning member being on a common horizontal plane with the longitudinal axis of the mounting plate, a second positioning member wherein said second positioning member is of an open L-shape form including a pair of legs of equal length, which are interconnected and both originating from a common apex point to form a right angle, said second positioning member has a longitudinal apex formed by the interconnection of said legs of said second positioning member, said second positioning member also having a front end and a rear end, said legs of said second positioning member are adjacent to said upper web surface of said first positioning member, with the longitudinal axis of said second positioning member being parallel with the longitudinal axis of said first positioning member and with the longitudinal axis of said second positioning member being on a common vertical plane with the longitudinal axis of said first positioning member, further positioned with said rear end of said second positioning member being on a common vertical plane with said rear end of said first positioning member, and a safety equipment receiving member wherein said safety equipment receiving member is an eyebolt, having an eyelet portion with a receiving aperture and an interconnected shank portion, said shank portion of said safety equipment receiving member is adjacent said longitudinal apex of said second positioning member with said eyelet portion of said safety equipment receiving member projecting forwardly past said front end of said second positioning member, further positioned with the longitudinal axis of said safety equipment receiving member being parallel with the longitudinal axis of said second positioning member and the longitudinal axis of said safety equipment receiving being on a common vertical plane with the longitudinal axis of said second positioning member, said eyelet portion of said safety equipment receiving member being further positioned with said eyelet portion being parallel with said top edge of said mounting plate; and wherein said fall arrest safety anchorage device is secured to a planar surface mounting area of said rigid planar substrate by mounting means of said mounting plate such that said first positioning member extends outward from said mounting plate and said planar surface mounting area, and said second positioning member extends outward from said first positioning member so that said safety equipment receiving member clears said planar surface mounting area by a predetermined planar parallel clearance as measured parallel to said planar surface mounting area and by a predetermined planar perpendicular clearance as measured perpendicular to said planar surface mounting area so that said safety equipment receiving member is at a desired location for receiving and securing personal fall arrest safety equipment.

13. A fall arrest safety anchorage device for mounting on a rigid planar substrate comprising:

a metallic mounting plate wherein said metallic mounting plate has a planar mounting surface, a first metallic positioning member wherein said first metallic positioning member is angularly attached to said metallic mounting plate at a predetermined first position and a predetermined first angle, and said first metallic positioning member extends outward from said metallic mounting plate for a predetermined first distance, a second metallic positioning member wherein said second metallic positioning member is angularly attached to said first metallic positioning member at a predetermined second position and a predetermined second angle, and said second metallic positioning member extends outward from said first metallic positioning member for a predetermined second distance, and a metallic safety equipment receiving member wherein said metallic safety equipment receiving member is angularly attached to said second metallic positioning member at a predetermined third position and a predetermined third angle, and said metallic safety equipment receiving member is adapted to receive and to secure personal fall arrest safety equipment; and wherein said fall arrest safety anchorage device is secured to a planar surface mounting area of said rigid planar substrate by mounting means of said metallic mounting plate such that said planar mounting surface of said metallic mounting plate is adjacent to said planar surface mounting area, and such that said metallic safety equipment receiving member clears said planar surface mounting area by a predetermined planar parallel clearance as measured parallel to said planar surface mounting area and by a predetermined planar perpendicular clearance as measured perpendicular to said planar surface mounting area so that said metallic safety equipment receiving member is at a desired location for receiving and securing personal fall arrest safety equipment.

14. The fall arrest safety anchorage device of claim 13, wherein said metallic mounting plate has a plurality of mounting apertures for receiving fasteners.

15. The fall arrest safety anchorage device of claim 13, wherein said first metallic positioning member is attached to said metallic mounting plate such that said first metallic positioning member extends from said metallic mounting plate at substantially a right angle.

16. The fall arrest safety anchorage device of claim 15, wherein said second metallic positioning member is attached to said first metallic positioning member such that said second metallic positioning member extends from said first metallic positioning member at substantially a right angle.

17. The fall arrest safety anchorage device of claim 16, wherein said metallic safety equipment receiving member is attached to said second metallic positioning member such that said metallic safety equipment receiving member extends from said second metallic positioning member at substantially a right angle.

18. The fall arrest safety anchorage device of claim 17, wherein said metallic mounting plate has a plurality of mounting apertures for receiving fasteners.

19. The fall arrest safety anchorage device of claim 18, wherein said metallic safety equipment receiving member projects toward the plane of said planar surface mounting area.

20. The fall arrest safety anchorage device of claim 19, wherein said metallic mounting plate is of a planar rectangular form.

* * * * *